United States Patent [19]

Prosenz

[11] 4,376,594

[45] Mar. 15, 1983

[54] TRAFFIC GUIDE EMPLOYABLE AS A MEDIAN BARRIER AND ROAD EDGE BARRIER

[76] Inventor: Pius Prosenz, Neunkirchner Str. 42a, A-2700 Wiener Neustadt, Austria

[21] Appl. No.: 199,930

[22] PCT Filed: Dec. 14, 1979

[86] PCT No.: PCT/AT79/00009

§ 371 Date: Aug. 15, 1980

§ 102(e) Date: Aug. 14, 1980

[87] PCT Pub. No.: W080/01292

PCT Pub. Date: Jun. 26, 1980

[30] Foreign Application Priority Data

Dec. 15, 1978 [AT] Austria ..... 8949/78

[51] Int. Cl.[3] ..... E01F 13/00

[52] U.S. Cl. ..... 404/6; 404/9; 404/13

[58] Field of Search ..... 404/6, 7, 9, 12, 13; 256/13.1, 1

[56] References Cited

U.S. PATENT DOCUMENTS

| | | | |
|---|---|---|---|
| 1,927,189 | 9/1933 | Sory | 256/13.1 X |
| 2,153,392 | 4/1939 | Robertson | 404/16 X |
| 2,994,255 | 8/1961 | Trief et al. | 404/7 |
| 3,326,099 | 6/1967 | Cova et al. | 404/7 |
| 4,307,973 | 12/1981 | Glaesener | 404/6 |

FOREIGN PATENT DOCUMENTS

| | | | |
|---|---|---|---|
| 1232158 | of 1960 | France | 404/7 |
| 710804 | of 1966 | Italy | 256/13.1 |
| 408985 | of 1966 | Switzerland | 404/7 |
| 884318 | of 1961 | United Kingdom | 404/7 |
| 1209646 | of 1970 | United Kingdom | 404/7 |

OTHER PUBLICATIONS

"Concrete Median Barrier Safely Redirects Impacting Cars" by Edwin C. Lokken, M. Asce–Oct. 1971–Civil Engineering ASCE, (pp. 77–80).

*Primary Examiner*—Nile C. Byers, Jr.
*Attorney, Agent, or Firm*—Karl F. Ross

[57] ABSTRACT

A traffic guide provision is described with a twosided profile to be employed as a median barrier of roads or with a onesided profile to be employed as road edge barrier wherein the profile is provided with a substantially vertical lower side face (1), via run-up edge (2) followed by an inclined towards the outside running run-up face (3) and above a deflection strip (4) staggered towards the outside relative to the run-up edge (2) and acting upon a vehicle below the automobile body.

6 Claims, 9 Drawing Figures

TRAFFIC GUIDE EMPLOYABLE AS A MEDIAN BARRIER AND ROAD EDGE BARRIER

CROSS REFERENCE TO RELATED APPLICATION

This application is a national phase application of the Patent Cooperation Treaty application Ser. No. PCT/AT/29/00009 filed Dec. 14, 1979 and based upon Austrian application Ser. No. A 8949/78 filed Dec. 15, 1978.

FIELD OF THE INVENTION

The invention relates to a traffic guide with a profile on two sides to be employed as a median barrier for roads or with a one sided profile to be employed as a road edge barrier, wherein the profile is provided with a substantially vertical lower side surface, a run-up face adjoining with a run-up edge to the vertical lower surface and running inclined to the outside and thereabove with a deflecting strip staggered towards the outside relative to the run-up face and interacting with the motor vehicle below the automobile body.

BACKGROUND OF THE INVENTION

Roadway dividers and barriers acting only on the wheels and the steering of the motor vehicle have been developed, since automobile body active guides suffer from obvious disadvantages. When these are rigid, for example steel rails or concrete walls, then deformation and considerable damage of the impacting parts of the motor vehicle occurs under high decelerations and uncontrolled deflection angles. Flexible catch devices (wire nets and ropes) require a large amount of space with their necessary effective depth. Sometimes too little protection is provided against penetration and the repair and maintenance costs are high. Semirigid guides (aluminum or steel sheet profile guard rails) require less space and decelerate vehicles less abruptly, but they generate high repair costs for the motor vehicle and the guard rail. For large kinetic energies, the penetration resistance is also too low. Also guides acting both on the wheels and steering as well as on the automobile body are not satisfactory. Such structures have been developed in the United States and have been applied worldwide (New Jersey profile, MB 5). They provide an inclined rising base and then a nearly vertical concrete wall of a height of about 1 m. The wheels near the barrier run initially up and are lifted thereby producing an overturning moment. Only then can the automobile body parts contact the wall reflectively. This problem has never been satisfactorily overcome nor can damage to the vehicle be minimized.

Thus, there is the desire for employing guides which act solely on guides have hardly ever been employed, since it has not been possible in the past to provide a construction which met the following requirements:

1. The resulting redirecting forces and therewith the injury risk of the passengers of an impacting vehicle should be kept as low as possible, 2. the impacting vehicle should not be damaged at all or the damage should be kept low, 3. a damaging of the guide by the impact of the vehicle should be prevented, 4. crossing, jumping over or sideways rolling over should be reliably prevented, 5. the skidding off vehicle should be able to be guided with operable steering and if possible without uncontrolled deflection into the lane, 6. this redirecting should be effected in the same way for both rolling and skidding vehicles, and 7. the barrier height and width should be as low as possible should be provided for widespread use.

For example, in a publication by Dunlap in Highway, Res. Rch. 460,1973 page 3 several profiles are described, which were subjected to a test series in 1953 in California. These profiles have in each case a total height of at most 35 cm and do not act on the automobile body. They can have a simple outwardly inclined bevelled surface which has been found to be substantially useless, since only in few cases could they prevent a passing over the upper edge by the vehicle. If they are provided on their upper edge with a deflecting strip protruding against the lane, then their effectiveness is much higher. Damage to the wheels and wheel mountings however occurs even at low velocities, since the provision also at low velocities and impact angles results in a hard impact of the rim.

In a publication by Jehu in Traffic Engineering and control, Vol. 5, Nr. 9 Jan. 1964 there is described a traffic guide device in the form of the Belgian drip edge stone (Trief-Randstein), which corresponds to the barrier already described and wherein correspondingly a substantially vertical lower edge surface is situated immediately in front of an upper deflection strip. This edge surface however reaches so far upwards, that it does not act on the tire only, but abruptly acts on the rim itself. This corresponds to a repositioning of the deflection strip according to the California profiles downward, results in large overturning moments and correspondingly poor experimental results according to the presentation by Dunlap cited above. If the vehicle rided above the lower edge surface of the drip edge stone, then it does not receive at the following, slightly inclined bevelled surface a substantial influence towards a guiding back onto the lane so that also the steep surface disposed behind this bevelled surface and hardly protruding has little effect.

Another guide has been developed in Sweden (Tri-Bloc, see for example VDI-Nachrichten, Nr. 23, June 8, 1979) and acts only on the wheels and the steering. It employs two concavely curved and prismatically shaped faces of 0.8 to 1 m height, which employ without automobile body contact the steering geometry of a running up wheel for the slow redirection to the travel lane. Driving experiments in fact have shown poor results for rolling vehicles at low impact angles. Experiments with larger impact angles or with skidding processes, respectively, are not known; based on the overturning edge close to the ground and a lacking deflecting upper edge a jumping over with catapult effect or a rolling over, respectively, of the vehicle onto the opposite side should not be prevented. In any case this barrier does not meet the requirement of low height and small width. It is therefore not only expensive, but also an optical barrier, which according to experience reduces the road width used by the traffic.

OBJECT OF THE INVENTION

It is the object of the invention to provide a guide barrier which acts solely on the wheels and steering, which meets all requirements laid down and which avoids the cited disadvantages of such known installations.

SUMMARY OF THE INVENTION

The invention resolves the presented task by providing that the run-up face from the run-up edge located below the height of usual tire equipment at least to the foot point of a plumb bob lowered from the deflection strip runs progressively more steeply and that this foot point is located in the middle region of the vertical distance between the run-up edge and the lower side of the deflection strip.

Such a construction results in a three phase course of effects, as is provided in none of the known installations. Initially there is only a contact with the lower vertical side face of the guide and thus a first effect is of the steering in the sense of redirection. An overturning of the vehicle already around the upper edge of this side face however does not occur, since the edge interacts still in the region of the elastic tire and is rolled over with larger impact angles or velocities. If the run-up edge is overcome this way, then in the second phase of the redirecting process a progressively steeper run-up face becomes effective. In the case of acute impact angles this influences the steering dynamics already sufficiently in order to deflect the vehicle, without further contact with the guide, in the direction of the lane. Furthermore it lifts the wheels near the band, rolls the front wheel forward in travelling direction, and then the front circumference of the tire contacts the deflecting strip. The deflecting strip is located at least in the now present lifted position of the vehicle slightly under the automobile body edge of usual automobile types, thus does not act on the automobile body but only on the wheels. The rounding of this edge, its low friction cover and its protrusion over the friction intensive steep flank below prevent further climbing of the wheel.

In the third phase the wheel is urged by the deflection strip into lane direction whereupon the steering dynamics effects a steering of the vehicle in the lane direction. If this does not succeed completely based on large momentum of the vehicle, then the vehicle with its front and possibly also rear wheel strikes broadside at the deflection strip and an overturning and sideways overrolling is prevented, since the deflection strip becomes a very high acting overturning edge and the center of gravity of the vehicle has been lowered relative thereto by the lifting near the band. The partial forces acting in the direction of the lane move the vehicle without sudden braking in the desired direction. This process also develops with a skidding vehicle. The components of motion decoupled in the skidding motion of the wheel rolling direction and the motion of the center of gravity are transformed by the described guide effect into a controlled rolling motion in the direction of the road lane.

As follows from the preceding description, the coaction of the protruding deflection strip with the below positioned run-up face is of decisive importance in the present invention. If the deflection strip protrudes too far, then the run-up face is rendered substantially ineffective; one sacrifices this way not only a soft redirection in basically harmless situations but also the advantages resulting from the lifting of the vehicle by way of the run-up surface. These are especially that the deflection strip is disposed somewhat higher and that thus the overturning moment of the vehicle can be decreased, when the vehicle with lifted up wheels, that is with lifted up automobile body, meets the deflection strip.

If the deflection strip does not protrude sufficiently over the run-up face or if the run-up face is not sufficiently steep, then there is the danger that the wheel will run over the deflection strip, since it is not pushed away in time from the run-up face and thus looses its grip. Only when the foot point of the plumb bob lowered from the deflection strip, that is the place from which the deflection strip tries to separate the wheel from the run-up surface, is located at a middle height, can all requirements be met. A middle height is presumed to be, when the foot point is located between the first and second third of the vertical distance of the run-up edge and the lower side of the deflection strip.

An optimal use of the small height available is achieved, when the average slope of the run-up face between the run-up edge and the foot point of the plumb bob lowered from the deflection strip is about 45° and when the slope at the foot point is about 60°.

The height of the run-up edge above road level is to be selected of such height that with the usual tire thicknesses there is just no overturning of the vehicle occurring based on rim contact. A height of 6 cm has proven to be suitable.

SPECIFIC DESCRIPTION

Figure 1:
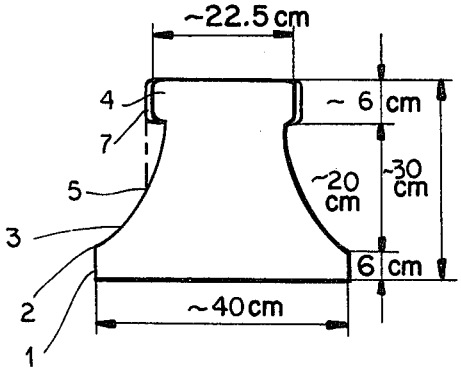
FIG. 1 is an end view of a guide useful as a median barrier.
Figure 2:
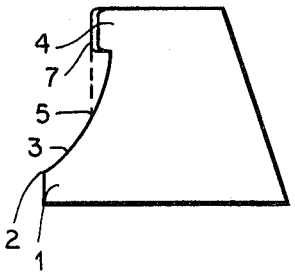
FIG. 2 is a corresponding view of a road edge barrier.
Figure 3:
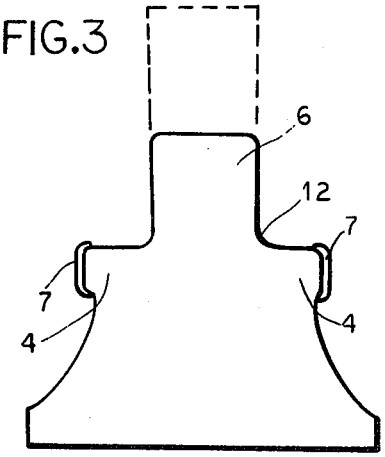
FIG. 3 is a variation of the guide according to FIG. 1 for use on high speed roads.

In accordance with FIGS. 1–3 the profile comprises from bottom to top a vertical lower face 1, which changes at the run-up edge into a curved run-up face 3 followed by the deflection strip 4 at the end of the steep flank. The run-up edge has a height of 5 to 6 cm so that it can barely be overridden by a running in or skidding wheel; the deflection strip is sufficiently wide that it, together with a sheet metal profile reinforcement can resist a beating wheel without damage; it is set inwardly with respect to the run-up edge so far that the running up or skidding wheel is further lifted up through the lower part of the run-up face; relative to the steep upper flank part, however, it protrudes so that larger frictional forces and thus a climbing tendency of a rolling wheel are avoided.

FIG. 1 shows an embodiment as a median barrier with a profile formed on both sides. FIG. 2 shows an embodiment serving as an edge barrier with a one side profile. FIG. 3 represents a possible profile variation for high speed roads. As an additional protection against overclimbing and jumping over there is provided here above the deflection strip 4 an additional deflector wall 6 such that contact with protruding parts of the front end is further avoided upon impact under acute angles, but possibly climbing wheels find a corresponding resistance. The step 12 between the top part and the additional deflector wall 6 provides a guide groove for the inclined positioned wheel, which prevents further climbing up and thus a rolling over. For obtuse angle impacts the guide installation acts as a rigid, automobile body active barrier.

An enlargement of the profile shown (apart from the side face 1) for example in the ratio 1:2 or an enlargement of individual profile parts can be employed for curves, where heavy vehicles are to be prevented from crashing or from cutting the inner curve edge, respectively, or for other purposes. This can account for increased climbing tendencies and for the large compressions of the rigid rear wheels with large loads. Passenger cars with only small speeds are also deflected from the twice as large run-up face again without automobile body contact.

Passages can be provided in the base of the elements or below the same in the road lane for purposes of dewatering the road lane or for other purposes.

Figure 4:
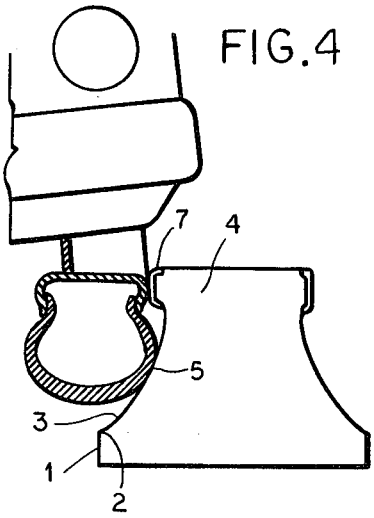
FIG. 4 corresponds to FIG. 1 wherein for illustrating the mode of operation the partially sectional, schematic view of a vehicle is added.

The operation of the barrier in accordance with the present invention are described below with specific reference FIG. 4.

When a front wheel runs or skids over the run-up edge 2 and then on the lower part of the run-up face 3, there arises in the case of acute impact angles via a deflecting influence of the steering dynamics a sufficient redirection effect to steer the vehicle without further contact with the guide or barrier into the road lane direction. Furthermore the wheels near the bands are lifted up. In case the front wheel nevertheless continues to roll in the run-up direction, then the front circumference hits the deflection strip 4. The rounding of its edges, its small friction surface and its protrusion over the friction intensive steep flank below as well as the beginning overturning forces prevent a climbing of the wheel substantially above the point 5 representing the intersection of this flank with a vertical cropped from the deflection strip. The wheel is beaten in road lane direction, whereupon the steering dynamic effects a turning of the vehicle in the direction of the road lane.

The barrier comprises preferably a hard, breakage and pressure safe material, for example concrete, reinforced with steel. Also other materials such as metal, plastic, asphalt can be employed in conventional ways as full or hollow profiles, possibly with a concrete casting. The deflection strip 4 can be covered with a hard profile 7 for example from 3 mm steel sheet for limiting friction and damage. The surface of the barrier can be provided with a low friction cover closing the surface.

Figure 5:
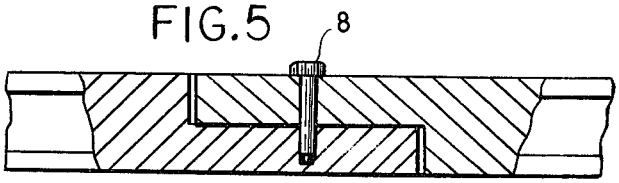
FIG. 5 is a partially sectional side view of two swivel mounted movable individual elements of the guide provision.
Figure 6:
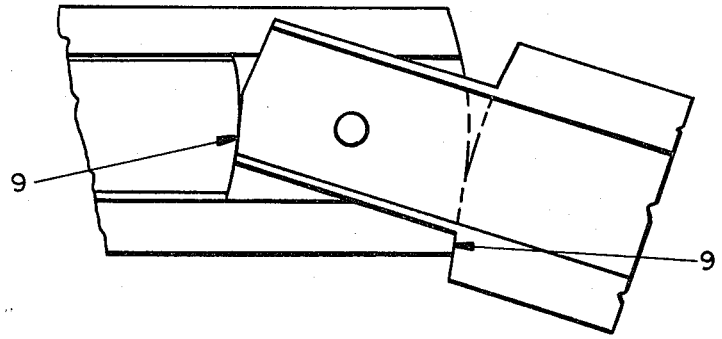
FIG. 6 is the corresponding top view in a dislocated position resulting from an impact.

Two preferred production methods of the guide provisions are possible:

Prefabricated elements are individual elements of a desired length, for example 4 m long for practical reasons, having the described profile and provided on top with a cast in lift hook or other support points. They can be placed on the road for temporary bars as a movable barrier without anchors, but also as a permanent barrier adhesively attached, dowelled or edged by a rolled or cast road surfacing material with a correspondingly extended foot. The stability of the element chain is based on the axial connection of the elements to one another (FIGS. 5 and 6). Push and pull in the direction of the road lane are distributed over the mass of connected elements. Push in a transverse direction is initially accomodated by a shifting of the element, but then by the swivel element connections, for example formed as the shown pin joint 8 by fixedly positioned and correspondingly dimensioned steel bolts with a diameter of about 30 mm. Overturn motions are prevented by the overlap of the elements. The shifting over a certian distance, for example 20 cm, is limited by the contacting of large-dimension inclined stop surfaces. The elements can be put in place again without damage. A replacement of an element is possible after a loosening of two bolts. Cast in supports can receive reflector lenses, traffic signs, light posts etc. and electrical lines can be run protected at the bottom side of the deflection strips. Curves with larger radii can be constructed with straight elements having slight kinks at their connection points; smaller curve radii require curved cast elements.

The casting molds for production of prefabricated elements comprise a base face, which corresponds to the cover face of the element in the preferably on the head standing fabrication method, the two side profile molds, which are pressed against the base face and the two end parts which are stopperlike slid into the side parts and thereby provide support and proper position to the same. At the end molds cylinders are provided for the bolt hole in the upper positioned and for the threaded pin fixation in the lower positioned overlaps. At the mold floor are inserted the hard profiles for the deflection strip and supports for later to be attached signs are adhesively attached as points.

The molds for curved elements comprise bendable, rubberlike material. They are pressed on the base face made for the proper radius on both sides. The precise maintenance of the profile mold in all sections is assured by profile clamps attached at corresponding distances. The overlapping end pieces are formed with the slid in stopper as employed in the straight elements. Thus the flexible side part molds can be employed for the varied curve radii. Other production processes such as extrusion pressing etc. are also possible in the known way.

Figure 7:
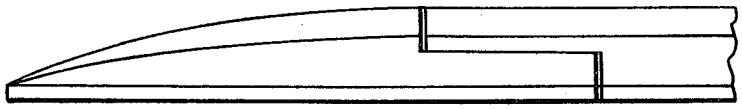
FIG. 7 is a side view of a terminal element.
Figure 8:
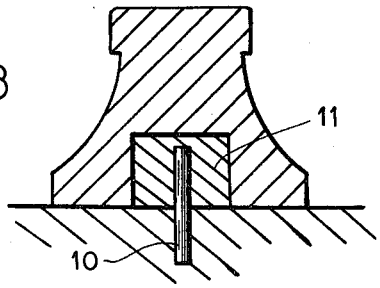
FIG. 8 is a transverse section through the embodiment of FIG. 7.
Figure 9:
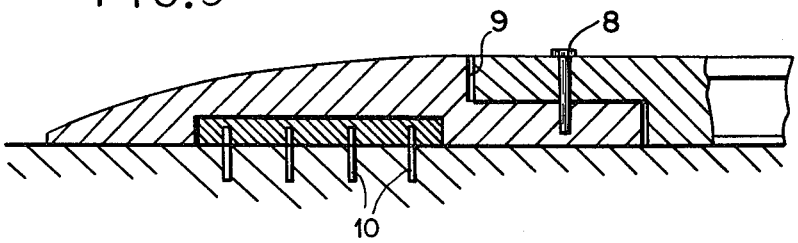
FIG. 9 is the corresponding longitudinal view.

Initial and terminal parts of a barrier are formed according to FIGS. 7 to 9. They can be placed for low vehicle speeds without anchoring, but they can also be adhesively attached or with a recessed middle groove be placed over steel bolts driven into the road and the hollow space 11 (FIG. 8) can be filled from the rear with concrete.

Continuous barriers locally cast by sliding shell concrete machines are provided by employing continuously sliding shell faces corresponding to the described profile over a prefabricated simple reinforcement on the road subground. Their base can also be sunk. The hard profiles for the deflection strip are inserted in guides at the shell faces and are in longitudinal direction connected to each other by way of screws or hooks. Various supports can be placed into the concrete while still soft. After the hardening of the concrete the final road surface is placed in position or rolled on, respectively, under maintenance of the height of the run-up edge. The barrier can also be constructed together with the road surface construction as one work process.

As initial and terminal parts serve corresponding parts from prefabricated elements, wherein the connection face allows a solid connection, for example with matching teeth or with connecting steel reinforcement.

I claim:

1. A road barrier comprising:

a rigid elongated concrete body extending along a travel lane and rising above the grade thereof to a height of about 30 cm to lie below lateral chassis portions of a vehicle traveling on said lane, said body having a vertical lower face turned toward said lane and extending upwardly from grade to an edge about 6 cm above grade, a continuously curved flank of progressively increasing steepness rising from said edge concave toward said lane and progressively receding upwardly from said lane, and a bead projecting laterally towards said lane at the top of said flank and overhanging said flank; and a strip of a material having lower friction than concrete and harder than concrete on said bead, verticals from outermost surfaces of said strip intercepting said flank substantially along the midpoint of the height thereof between said edge and said bead.

2. The barrier defined in claim 1 wherein said strip had a height of about 6 cm and a rounded upper edge.

3. The barrier defined in claim 1 wherein the average steepness between said edge and said midpoint is substantially 45° and the steepness at said midpoint is about 60°.

4. The barrier defined in claim 1, claim 2 or claim 3, further comprising an upwardly extending wall set inwardly from said impede and formed on the top of said body.

5. The barrier defined in claim 1, claim 2 or claim 3 wherein said body is symmetrical on opposite sides of a vertical median plane and forms a median barrier.

6. The barrier defined in claim 1, claim 2 or claim 3 wherein said body is asymmetrical and has a flat flank on its side opposite the side provided with said curved flank.

* * * * *